US007008506B2

(12) United States Patent
Scherb et al.

(10) Patent No.: US 7,008,506 B2
(45) Date of Patent: Mar. 7, 2006

(54) MACHINE AND PROCESS FOR PRODUCING A TISSUE WEB

(75) Inventors: Thomas Thoröe Scherb, Sao Paulo (BR); Harald Schmidt-Hebbel, Barueri (BR)

(73) Assignee: Voith Paper Patent GmbH, Heidenheim (DE)

( * ) Notice: Subject to any disclaimer, the term of this patent is extended or adjusted under 35 U.S.C. 154(b) by 601 days.

(21) Appl. No.: 09/769,462

(22) Filed: Jan. 26, 2001

(65) Prior Publication Data

US 2002/0060043 A1 May 23, 2002

(30) Foreign Application Priority Data

Jan. 28, 2000 (DE) ..... 100 03 686

(51) Int. Cl.
*B31F 1/12* (2006.01)
*D21H 11/00* (2006.01)

(52) U.S. Cl. ..... 162/111; 162/113; 162/205; 162/281; 162/358.3

(58) Field of Classification Search ..... 162/111, 162/113, 205, 281, 358.3
See application file for complete search history.

(56) References Cited

U.S. PATENT DOCUMENTS

| | | | | |
|---|---|---|---|---|
| 3,322,617 A | | 5/1967 | Osborne | |
| 5,393,384 A | | 2/1995 | Steiner et al. | |
| 5,492,598 A | | 2/1996 | Hermans et al. | 162/113 |
| 5,517,714 A | | 5/1996 | Kotitschke | |
| 5,527,428 A | | 6/1996 | Trokhan et al. | |
| 5,534,326 A | | 7/1996 | Trokhan et al. | |
| 5,556,511 A | * | 9/1996 | Bluhm et al. | 162/205 |
| 5,654,076 A | | 8/1997 | Trokhan et al. | |
| 5,746,887 A | | 5/1998 | Wendt et al. | 162/104 |
| 5,897,745 A | * | 4/1999 | Ampulski et al. | 162/205 |
| 6,004,429 A | | 12/1999 | Schiel | |
| 6,083,349 A | * | 7/2000 | Schiel | 162/358.3 |
| 6,103,062 A | * | 8/2000 | Ampulski et al. | 162/113 |
| 6,136,146 A | | 10/2000 | Phan et al. | |
| 6,193,839 B1 | * | 2/2001 | Ampulski et al. | 162/205 |
| 6,203,663 B1 | | 3/2001 | Kamps et al. | |
| 6,235,160 B1 | * | 5/2001 | Tietz et al. | 162/281 |
| 6,287,426 B1 | * | 9/2001 | Edwards et al. | 162/281 |

FOREIGN PATENT DOCUMENTS

| | | |
|---|---|---|
| DE | 4224730 | 9/1993 |
| DE | 4327601 | 1/1995 |
| DE | 19654198 | 6/1998 |
| DE | 19732879 | 2/1999 |
| EP | 1016754 | 7/2000 |
| SE | 427053 | 2/1983 |
| WO | 96/35018 | 11/1996 |
| WO | 99/06629 | 2/1999 |
| WO | 00/12817 | 8/1999 |

* cited by examiner

*Primary Examiner*—Mark Halpern
(74) *Attorney, Agent, or Firm*—Greenblum & Bernstein, P.L.C.

(57) ABSTRACT

The present invention is directed to a machine and process for producing a tissue web. The machine includes a forming area including at least one rotating continuous dewatering wire with zonally varied wire permeability, and at least one shoe press. The process includes dewatering the tissue web with at least the at least one continuous dewatering wire with zonally varied wire permeability, and pressing the tissue web in the at least one shoe press.

52 Claims, 8 Drawing Sheets

MACHINE AND PROCESS FOR PRODUCING A TISSUE WEB

CROSS-REFERENCE TO RELATED APPLICATIONS

The present application claims priority under 35 U.S.C. § 119 of German Patent Application No. 100 03 686.4, filed on Jan. 28, 2000, the disclosure of which is expressly incorporated by reference herein in its entirety.

BACKGROUND OF THE INVENTION

1. Field of the Invention

The invention relates to a machine for producing a tissue web having a forming area including at least one rotating continuous dewatering wire. It further relates to a process for producing a tissue web with the tissue machine.

2. Discussion of Background Information

Previous attempts have been made to influence the quality parameters of a tissue web, such as, e.g., water absorption capacity, water retention capacity, and water absorption rate, by configuring the surface structure of the web. The prior art (cf., e.g., U.S. Pat. No. 5,746,887, U.S. Pat. No. 5,492,598, SE 427053) suggests using "embossing wires" or "embossing felts." These wires or felts emboss their own surface structure onto the already formed tissue web. In this process, the tissue web is loaded with pressure, which counteracts the desired high volume (bulk). At the same time, this process requires a high expenditure for machinery since the embossing wires are used for this purpose alone. These processes are frequently also combined with special, expensive drying processes to increase the specific volume.

SUMMARY OF THE INVENTION

The present invention provides a machine and a process of the type mentioned at the outset with which the construction and the structure, i.e., the arrangement of the fibers, of a tissue web can be configured, in particular even at high machine speeds, so that the water absorption capacity, water retention capacity, water absorption rate, and specific volume (bulk) are increased or improved in as cost-effective a manner as possible.

With respect to the tissue machine, a feature according to the invention includes that at least one dewatering wire with zonally varied (different) wire permeability, i.e., a "DSP wire," is provided in the forming area, as well as at least one shoe press.

Due to this configuration, areas of high dewatering speed and areas of low dewatering speed are created in the sheet forming zone during the dewatering process. Thus, a tissue web is produced with zonally varied fiber percentages, as a result of which the water absorption of the web is increased and also proceeds at a faster rate. This influences the tissue web not only at the sheet surface, but via the total sheet volume, as a result of which the quality parameters improve considerably. The use of a DSP wire in combination with a shoe press has the particular advantage that, with the gentle pressing dewatering achieved by the shoe press, the advantageous structure in the tissue web for improving the water absorption capacity, water retention capacity, and water absorption rate is maintained and at the same time a voluminous web of high specific volume (bulk) is attained.

Wires of zonally varied permeability are known, for example, from SE 427053. According to this publication, the wires in question can include, e.g., a fabric in which longitudinal and transverse yarns provided in one or more planes in accordance with a specified pattern are woven together so that systematically distributed areas of suitable size are formed in which the number of points of intersection is zero or distinctly fewer than in the woven structure of the remaining fabric.

A preferred practical embodiment of the machine according to the invention includes a former with two rotating continuous dewatering belts that converge, forming a stock entry gap, and are then conducted over a forming element such as, in particular, a forming roll, with a dewatering wire with zonally varied wire permeability being provided as an outer belt not coming into contact with the forming element and/or as an inner belt.

In certain cases, it is advantageous for the shoe press to be provided as a separate unit in the web travel direction behind the unit including the forming element and the two dewatering belts. The shoe press can thus be provided, in particular, as a free-standing press.

In an alternative embodiment of the machine according to the invention, the tissue web carried by one of the two dewatering belts subsequent to the forming element, is conducted through the shoe press together with this dewatering belt.

As an opposing element to the shoe press unit, it is advisable for the shoe press to include a drying cylinder, preferably a Yankee cylinder.

The shoe press unit can be constructed, for example, as described in EP 99 125 789. According to this publication, the shoe press unit can be arranged as a so-called "short-shoe" and have, for example, a press nip whose length, viewed in the web travel direction, is less than or equal to a value of about 60 mm and whose pressure profile along the length of the press nip has a maximum pressing pressure greater than or equal to a value of about 3.3 MPa. With such a shoe press unit, it is possible to achieve as high a solids content and/or specific volume as possible, while largely maintaining the quality features required for the produced web.

According to an alternative embodiment likewise described in EP 99 125 789, the shoe press unit can be arranged as a so-called "longshoe" and have, for example, a press nip whose length, viewed in the belt travel direction, is greater than a value of about 80 mm and preferably less than about 200 mm, in particular a maximum of about 150 mm, and whose pressure profile over the length of the press nip has a maximum pressing pressure less than or equal to a value of about 2 MPa. In this manner, the web is dewatered in a particularly gentle manner and, in combination with a DSP wire, a particularly high bulk is achieved. The web gains a higher water absorption capacity thereby. A further positive effect is that the water is absorbed more rapidly.

The shoe press unit can otherwise be constructed, for example, as described in EP 99 125 789.

In certain cases, it can also be advantageous for a drying zone to be provided in which the tissue web can be acted upon at least partially by pressurized displacement gas (TAD, Through Air Drying).

According to a useful embodiment, a twin wire former can be provided, for example, as the former. A dewatering wire with zonally varied wire permeability, i.e., a "DSP wire," can be provided here as an outer belt and/or as an inner belt. If only one of the two belts is formed by such a DSP wire, the other belt can be a conventional dewatering wire for tissue.

In a useful alternative embodiment, a crescent former is provided as the former, whose outer belt is formed by a dewatering wire with zonally varied wire permeability and whose inner belt is formed by a felt belt.

The maximum extension of the surface of the partial areas of the dewatering wire with zonally varied wire permeability is advisably Az<5 mm, preferably Az<3 mm.

It is also advantageous for the dewatering wire with zonally varied wire permeability to not be "needled" with felt-like fibers, but rather to include a fabric formed by filling and warp yarns, i.e., to include only of filling and warp yarns.

The zones of varied wire permeability of an applicable dewatering belt are advantageously produced using weaving yarns of varied diameter and/or varied weave pattern.

More advantageously, the dewatering wire with zonally varied wire permeability is used in an area in which the solids content of the tissue web is less than about 20% and, in particular, less than about 12%, and it is preferably used in the initial sheet forming area at a solids content of less than about 6%.

Since, owing to the varied permeability, fibers can penetrate into the volume of the wire and lodge there, it is preferable for a conditioning device such as, in particular, a wire cleaning device to be assigned to the dewatering wire of zonally varied wire permeability. For example, spray pipes with nozzles distributed over the machine width can be provided thereby. A Voith Sulzer "Duocleaner" with rotating high pressure nozzles and integrated suction extractor or a Voith Sulzer "Jet Cleaner" can also be used, for example, however.

The process of the invention is correspondingly characterized in that at least one dewatering wire with zonally varied wire permeability is used in the forming area, as well as at least one shoe press.

Advantageous embodiments of the process of the invention are given in the subclaims.

Suitable wires of zonally varied permeability are, for example, wires of the type described in PCT/GB99/02684. According to this application, the wires in question can include in particular of a fabric in which yarns provided in one or more planes and running in a first direction are woven together with yarns running in a second direction in such a way that a grid is formed that separates a number of systematically distributed areas of specified configuration from one another and fixes them accordingly, with the systematically distributed areas each including at least three yarns running in the one direction and at least three yarns running in the other direction. The yarns can be in particular filling yarns and warp yarns.

The present invention is directed to a machine for producing a tissue web. The machine includes a forming area including at least one rotating continuous dewatering wire with zonally varied wire permeability, and at least one shoe press.

In accordance with a feature of the invention, the machine includes a former having a forming element and two rotating continuous dewatering belts. The two rotating continuous dewatering belts can be arranged to converge to form a stock entry gap and can be conducted over the forming element as an outer belt, which does not contact said forming element, and as an inner belt. At least one of the outer and the inner belts includes the at least one rotating continuous dewatering wire with zonally varied wire permeability. The forming element may include a forming roll. Further, the shoe press can include a separate unit arranged behind, in the belt travel direction, a unit including the forming element and the two dewatering belts. The tissue web may be carried by one of the two dewatering belts subsequent to the forming element, and the tissue web and the one dewatering belt can be guided through the shoe press. Still further, the former can include a twin wire former. Alternatively, the former can include a crescent former, and the outer belt may be the at least one dewatering wire with zonally varied wire permeability and the inner belt may be a felt belt.

According to another feature of the instant invention, the shoe press may include a shoe press unit and an opposing element. The opposing element can include a drying cylinder. The opposing element can also include a Yankee cylinder.

Moreover, the shoe press can have a press nip length, viewed in a belt travel direction, less than or equal to about 60 mm and can have a pressure profile over the press nip length with a maximum pressing pressure greater than or equal to about 3.3 MPa.

Further, the shoe press may have a press nip length, viewed in a belt travel direction, greater than about 80 mm and may have a pressure profile over the press nip length with a maximum pressing pressure less than or equal to about 2 MPa. Still further, the press nip length may be less than about 200 mm, and preferably, the press nip length is a maximum of about 150 mm.

The machine can also include a drying zone in which the tissue web is acted upon at least partially by pressurized displacement gas.

The at least one dewatering wire with zonally varied wire permeability may be located in an initial dewatering area.

The at least one dewatering wire with zonally varied wire permeability can include a fabric formed by filling and warp yarns. Further, the at least one dewatering wire with zonally varied wire permeability can include a fabric formed only by filling and warp yarns. Moreover, zones of varied wire permeability of the at least one dewatering wire can be produced by at least one of weaving yarns of varied diameter and varied weave pattern.

A conditioning device can be assigned to the at least one dewatering wire with zonally varied wire permeability. The conditioning device may include a wire cleaning device.

The present invention is directed to a process for producing a tissue web in a tissue machine having a forming area including at least one rotating continuous dewatering wire with zonally varied wire permeability and at least one shoe press. The process includes dewatering the tissue web with at least the at least one continuous dewatering wire with zonally varied wire permeability, and pressing the tissue web in the at least one shoe press.

According to a feature of the present invention, the tissue machine can further including a former with a forming element and two rotating continuous dewatering belts arranged to converge to form a stock entry gap and then guided over the forming element as an outer belt, which does not contact the forming element, and as an inner belt. At least one of the outer and the inner belts can include the at least one rotating continuous dewatering wire with zonally varied wire permeability. The process can further include forming the tissue web between the inner and outer belts, and guiding the inner and outer belts and tissue web over the forming element. The forming element may include a forming roll, and the process may further include guiding the inner and outer belts and the tissue web over the forming roll. The shoe press can be arranged as a separate from, and behind in a belt travel direction, a unit including the forming element and the two dewatering belts. The process can also include carrying, after the forming element and on one of the two dewatering belts, the tissue web, and guiding the tissue web and the one dewatering belt through the shoe press. The former can include a twin wire former, or alternatively, the former can include a crescent former, and the outer belt comprises the at least one dewatering wire with zonally varied wire permeability, and the inner belt comprises a felt belt.

In accordance with another feature of the invention, the process can include dewatering at a machine speed greater than about 1300 m/min. Further, process can include dewatering at a machine speed greater than about 1500 m/min, and preferably at a machine speed greater than about 1800 m/min.

Moreover, the process may include dewatering the tissue web, in an initial dewatering area, with at least the at least one dewatering wire with zonally varied wire permeability.

The at least one dewatering wire with zonally varied wire permeability can be located in an area in which solids content of the tissue web is less than about 20%. Further, the at least one dewatering wire with zonally varied wire permeability may be located in an area in which solids content of the tissue web is less than about 12%. Still further, the at least one dewatering wire with zonally varied wire permeability may be located in an initial sheet forming area having a solids content of less than about 6%.

The present invention is directed to a tissue paper former which includes a forming element, at least two rotating continuous dewatering wires, in which at least one of the two rotating continuous dewatering wires has a zonally varied wire permeability, arranged over the forming element, as an outer wire not in contact with the forming element and as an inner wire, and at least one shoe press arranged downstream, relative to a wire travel direction, from the forming element.

According to a feature of the invention, the forming element may include a forming roll. The at least one dewatering wire with zonally varied wire permeability can include a plurality of zones, each zone having a maximum extension of less than about 5 mm. Further, the maximum extension of each the zone can be less than about 3 mm. Moreover, the former may be a crescent former, and the outer belt can include the at least one dewatering wire with zonally varied wire permeability and the inner belt can include a felt belt. A suction zone can be located within a loop of the inner belt, and a conditioning device associated with the outer belt. The suction zone may be located in the forming roll. The tissue web former may include an apparatus to one of control or regulate the suction zone. Further, the suction zone may include at least two suction zones separated in a belt run direction, and the tissue web former may include an apparatus to one of control or regulate the at least two suction zones.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
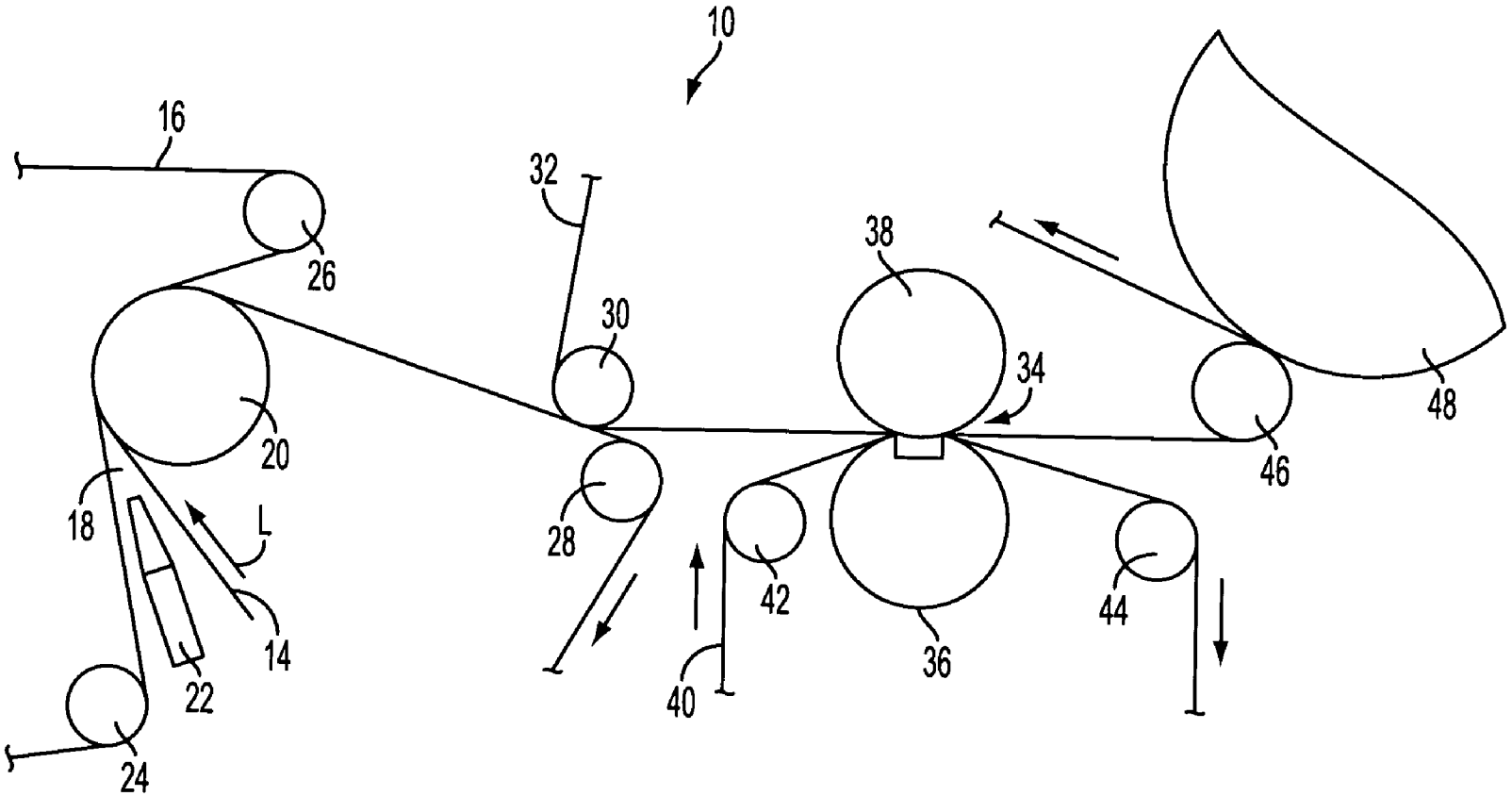
FIG. 1 is a schematic representation of a twin wire former of a machine for producing a tissue web, in which a dewatering wire with zonally varied wire permeability is provided as an outer belt and/or as an inner belt, and this "DSP wire" is used in combination with a free-standing shoe press.
Figure 2:
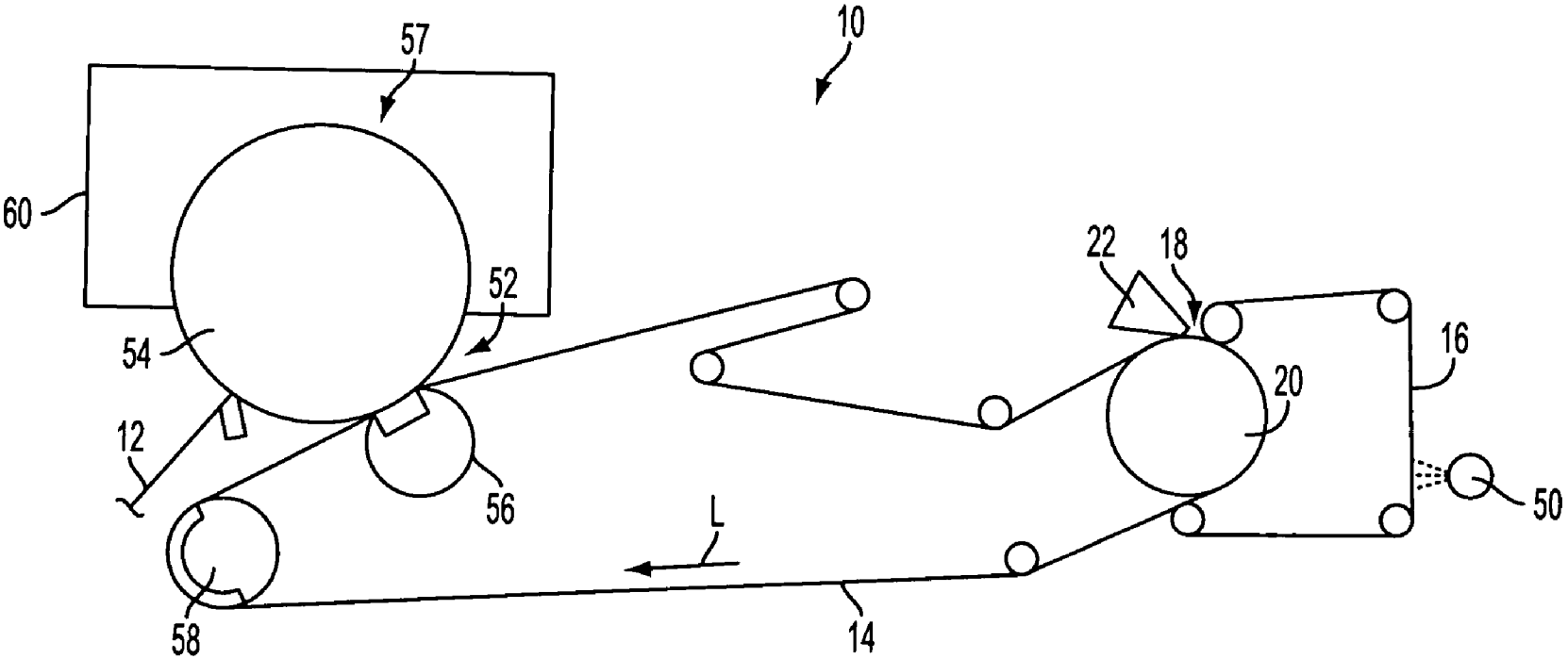
FIG. 2 is a schematic representation of a crescent former, in which a dewatering wire with zonally varied wire permeability is provided as an outer belt and a felt belt is provided as an inner belt, and in which subsequent to the forming roll the tissue web carried by the felt belt is conducted together with this felt belt through a shoe press.

The formers 10 shown in FIGS. 1 and 2 are each part of a machine for producing a tissue web 12. In the forming area, preferably in the initial dewatering area, at least one dewatering wire with zonally varied wire permeability, i.e., a DSP wire, is provided respectively. Each DSP wire is provided in combination with a shoe press.

The two formers 10 each include two continuous rotating dewatering belts 14, 16 that converge, forming a stock entry gap 18, and are subsequently conducted over a forming element, here formed by a forming roll 20.

The pulp suspension is introduced into the stock entry gap 18 by a headbox 22.

FIG. 1 shows in schematic representation a twin wire former 10 in which a wire is provided respectively as an inner belt 14 coming into contact with the forming roll 20 and also as an outer belt.

At least one of the two dewatering wires 14, 16 is provided as a wire with zonally varied wire permeability, i.e., as a DSP wire. Here, a conditioning device, such as, in particular, a wire cleaning device 50, can be assigned to each DSP wire (see FIG. 2).

In the present case, the pulp suspension delivered by the headbox 22 is sprayed from diagonally below into the stock entry gap 18 formed between the two dewatering belts 14, 16. The outer belt 16 coming from below is conducted over a guide roll 24 past the headbox 22 to the forming roll 20 and from there is conducted back again over a further guide roll 26.

The two dewatering belts 14, 16 are again separated from one another in the area of the forming roll 20. The inner belt 14 is conducted back again over a guide roll 28. In the belt travel direction L before the guide roll 28, the tissue web is taken over from the inner belt 14 by a waterproof belt 32 in the area of a guide roll 30 and is conducted to the press nip of a shoe press 34, which includes a shoe press unit 36 below as well as an opposing roll 38 above. Besides the upper waterproof belt 32 conducting the tissue web with it through the press nip of the shoe press 34, a lower felt 40 is conducted through that is conducted over a guide roll 42 or 44 both before and after the shoe press 34. The lower felt 40 is separated again from the waterproof belt 32 immediately after the press nip of the shoe press 34, in order to avoid a re-wetting. Subsequent to the shoe press 34, the waterproof belt 32 is conducted together with the tissue web to a transfer roll 46, in the area of which the tissue web is transferred to a tissue cylinder or Yankee cylinder 48.

In the present case, the shoe press 34 is thus provided as a separate unit in the belt travel direction L behind the unit including the forming element 20 and the two dewatering belts 14, 16.

FIG. 2 shows in schematic representation a crescent former 10 in which a dewatering wire with zonally varied wire permeability, i.e., a "DSP wire," is provided as an outer belt 16 not coming into contact with the forming roll 20. The inner belt 14 is formed here by a felt belt. A conditioning device 50 such as in particular a wire cleaning device can be assigned to the DSP wire 16.

Subsequent to the forming roll 20, the tissue web 12 being formed is conducted jointly with the inner belt 14 to the press nip 52 of a shoe press 57, which includes a shoe press unit, here a shoe press roll 56, and a drying cylinder, preferably a Yankee cylinder 54, as an opposing element.

In the present case, the tissue web 12 carried by the inner belt 14 subsequent to the forming roll 20 is thus conducted through the shoe press 57 together with this inner belt 14 formed by a felt.

In the belt travel direction L before the press nip 52, the inner belt 14 conducting the tissue web 12 is conducted over a device provided with suction, here a suction roll 58.

A drying hood can be assigned to the Yankee cylinder 54. The shoe press 34 or 57 can, for example, be constructed as described in EP 99 125 789, the disclosure of which is expressly incorporated by reference herein in its entirety. According to this document, such a shoe press 34 or 57 can, for example, have a press nip whose length, viewed in the belt travel direction L, is less than or equal to a value of about 60 mm (i.e., a shortshoe) and whose pressure profile over the press nip length has a maximum pressing pressure greater than or equal to a value of about 3.3 MPa.

According to an alternative embodiment likewise described in EP 99 125 789, the shoe press 34 or 57 can, for example, also have a press nip whose length, viewed in the belt travel direction L, is greater than a value of about 80 mm and preferably less than about 200 mm, in particular maximum about 150 mm (i.e., a longshoe) and whose pressure profile over the press nip length has a maximum pressing pressure less than or equal to a value of about 2 MPa.

The respective tissue machine can include a drying zone in which the tissue web 12 can be acted upon at least partially by pressurized displacement gas (TAD, Through Air Drying).

The dewatering wires with zonally varied wire permeability can consist, for example, of a fabric formed by filling and warp yarns. Here, the zones of varied wire permeability can be produced, for example, using weaving yarns of varied diameter and/or varied weave pattern.

Suitable wires of zonally varied permeability are, for example, wires of the type described in PCT/GB99/02684, disclosure of which is expressly incorporated by reference herein in its entirety. According to this application, the wires in question can include, in particular, a fabric in which yarns provided in one or more planes and running in a first direction are woven together with yarns running in a second direction, such that a grid is formed that separates a number of systematically distributed areas of specified configuration from one another and fixes them accordingly, with the systematically distributed areas each including at least three yarns running in the one direction and at least three yarns running in the other direction. The yarns can be in particular filling yarns and warp yarns.

Figure 3:
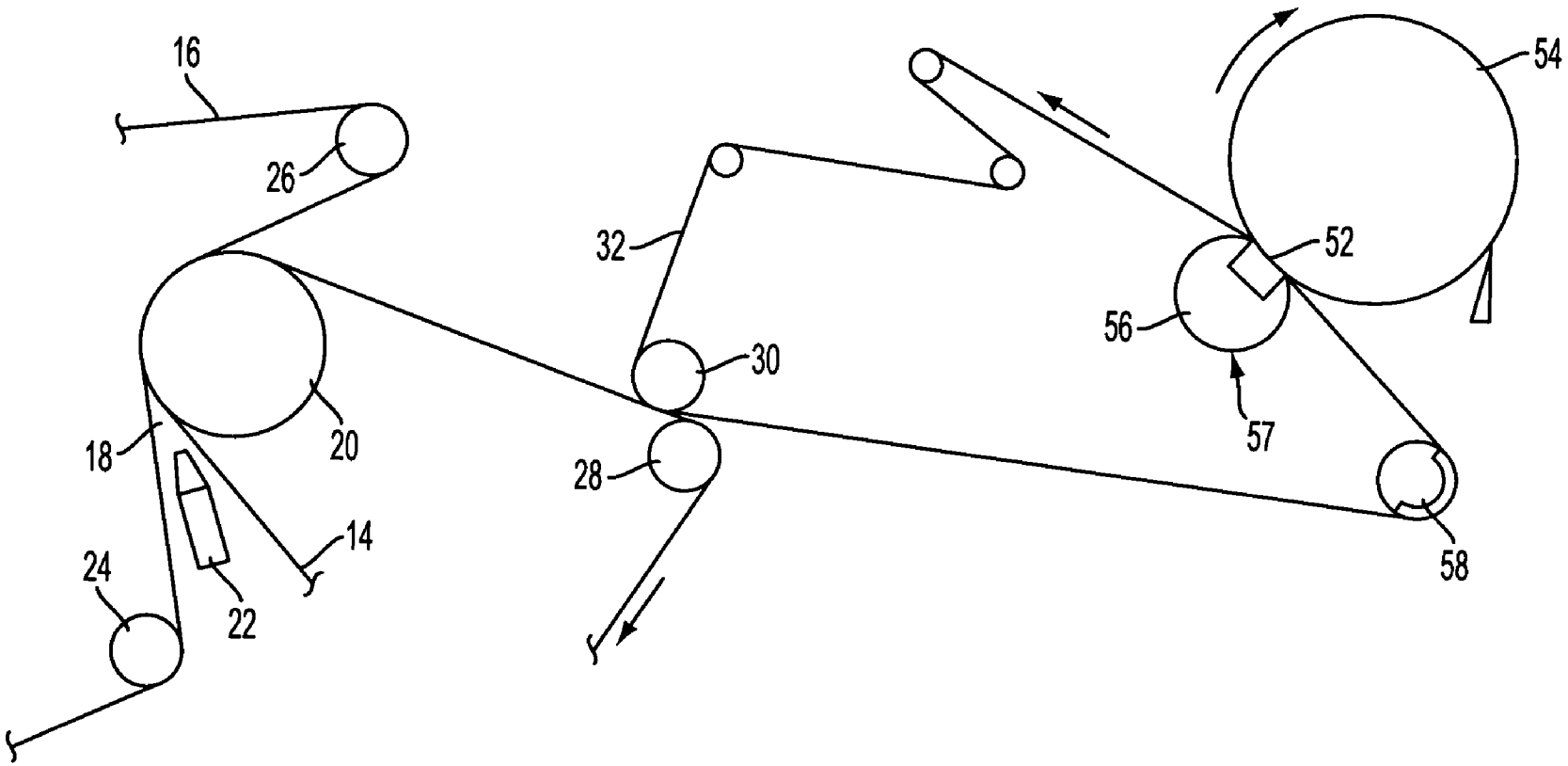
FIG. 3 is a schematic representation of a former resulting from a combination of the two formers shown in FIGS. 1 and 2.

FIG. 3 shows a former resulting from a combination of the two formers shown in FIGS. 1 and 2. Corresponding parts are provided with the same reference numbers.

Additionally, in the present case, the pulp suspension delivered by the headbox 22 is sprayed from diagonally below into the stock entry gap 18 formed between the two dewatering belts 14, 16. The outer belt 16 coming from below is conducted over a guide roll 24 past the headbox 22 to the forming roll 20 and from there is conducted back again over a further guide roll 26.

The two dewatering belts 14, 16 are again separated from one another in the area of the forming roll 20. The inner belt 14 is conducted back again over a guide roll 28. In the belt travel direction L before the guide roll 28, the tissue web is taken over from the inner belt 14 by a belt 32 in the area of a guide roll 30 and is conducted to the press nip 52 of a shoe press 57, which includes a shoe press unit, here a shoe press roll 56, and as the opposing element a drying cylinder, preferably a Yankee cylinder 54.

In the belt travel direction L before the press nip 52, the belt 32 conducting the tissue web 12 is again conducted over a device provided with suction, here a suction roll 58.

Figure 4:
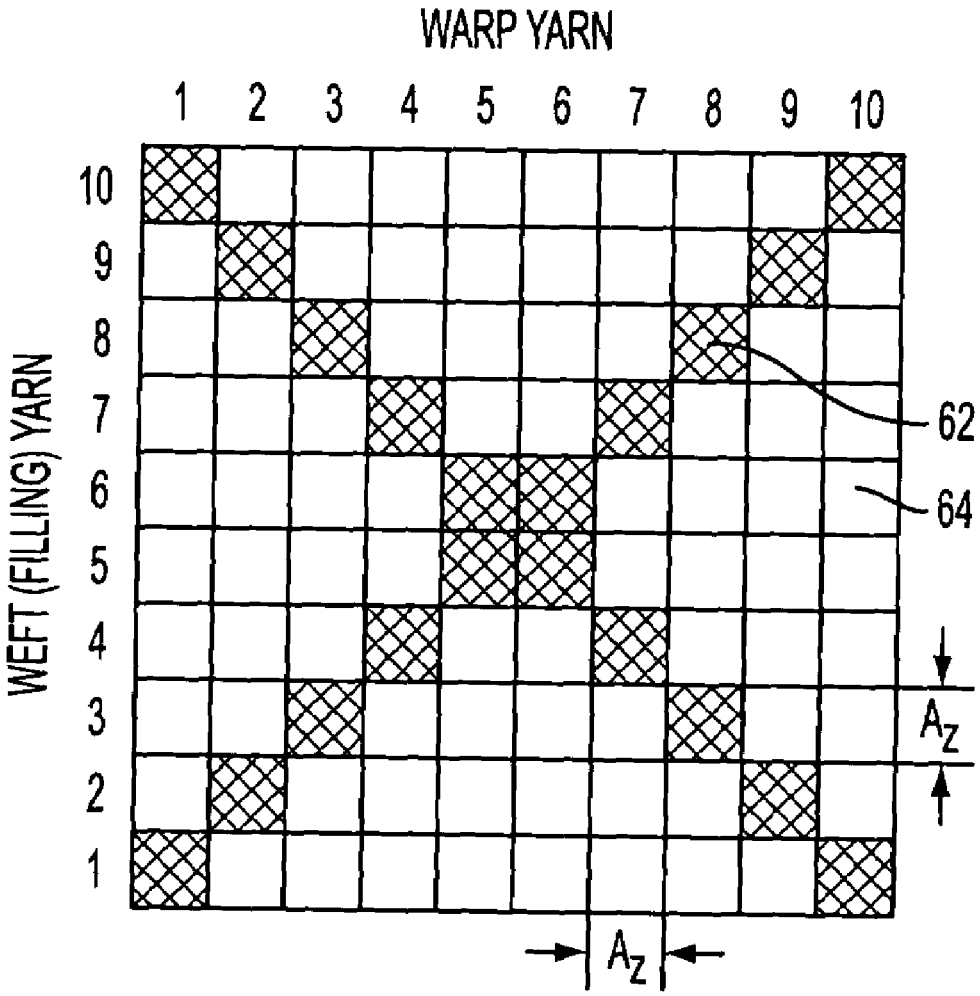
FIG. 4 is a weave pattern diagram of a repeating section of a dewatering wire with zonally varied wire permeability formed by a woven fabric.

FIG. 4 shows, purely by way of example, a weave pattern diagram of a repeating section of a possible embodiment of a dewatering wire with zonally varied wire permeability formed by such a fabric. In the present embodiment, the repeating weave pattern diagram includes ten warp yarns and ten filling yarns. In the area of the hatched squares, the filling yarn lies beneath the warp yarn. In the area of the light squares, on the other hand, the filling yarn lies above the warp yarn. Depending on the circumstances of each case, the one or else the other side of the weave pattern diagram can lie outside.

The hatched areas form a grid 62, by which a number of systematically distributed zones (areas) 64 of specified configuration are separated from one another and fixed accordingly. As shown in FIG. 4, the dimensions of the zones are depicted as Az, which can represent areas of high permeability or areas of low permeability, however, it is not necessary that these dimensions are the same. In any event, Az represents the length and/or width of zones having a permeability different than that of the other zones.

Figure 5:
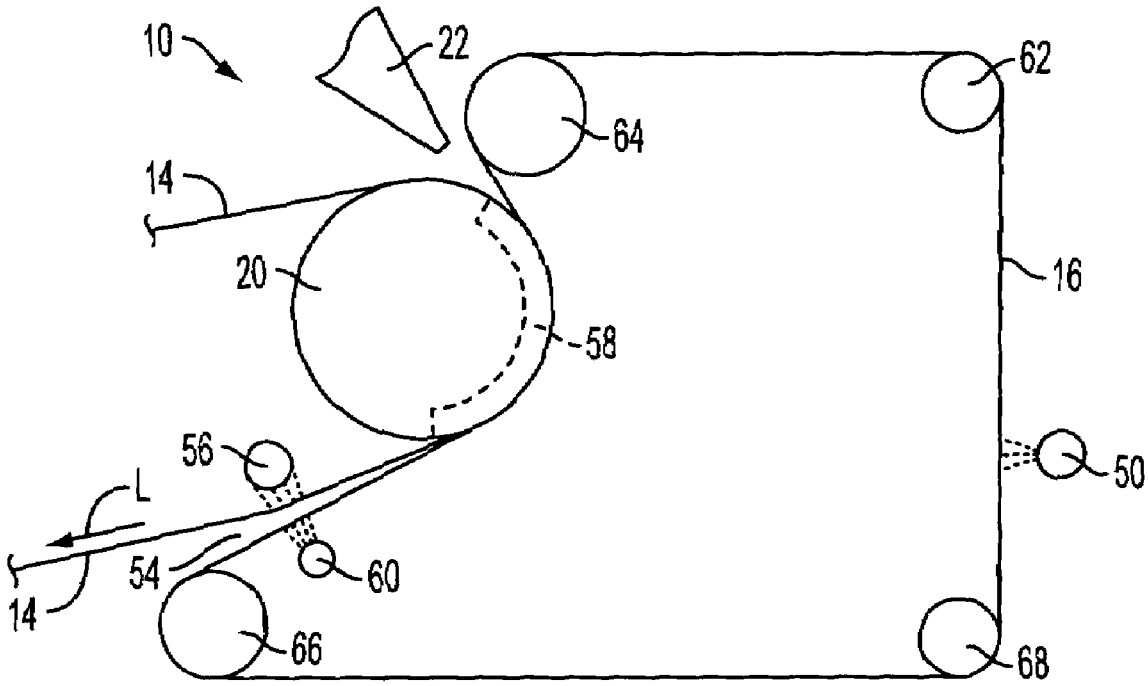
FIG. 5 shows an enlarged view of the forming zone depicted in FIG. 2, which includes a suction element inside the loop of the inner belt and a conditioning device assigned to the outer wire.

FIG. 5 illustrates an enlarged view of the forming zone of the former shown in FIG. 2, in which the essential details of the arrangement according to the invention are discernible.

The former utilizes at least one suction element 56 which is positioned inside the loop of inner belt 14, in the area of separation point 54. Separation point 54 is a position where outer wire 16 and inner belt 14 are separated from each other. Alternatively or additionally, forming roll 20 can be provided with a suction zone 58. With such a suctioned forming roll 20, the fibrous web is pulled against inner belt 14 which can be a felt belt.

In the embodiment shown, suction element 56 is located, in the web travel direction L, in the area of separation point 54, e.g., in this case positioned in front of separation point 54. The vacuum present in suction element 56 can be adjustable. This can also be the case for the vacuum of suction zone 58. Moreover, each device may have its vacuum adjusted by an independent mechanism, e.g., such that each device is independently adjusted, or by a common mechanism which controls vacuum to both devices. Additionally, suction elements 56 or 58 can be embodied such that they affect inner belt 14 at least essentially over its entire width.

In the area of separation point 54, at least one blowing element 60 can also be provided inside the loop of outer wire 16. As a result, outer wire 16 can be impacted from the inside with a medium, for instance, such as blowing air. Blowing element 60 can be suitably embodied such that it affects outer wire 16 at least essentially over its entire width.

Outer wire 16 can be guided over suitably arranged guide rolls 62, 64, 66 and 68. Moreover, outer wire 16 may be arranged with a conditioning device 50 which can particularly be a wire cleaning device. Conditioning device 50 is suitably embodied such that it affects outer wire 16 at least essentially over its entire width.

Conditioning device 50 may include a spray pipe, for instance, such as a "Duocleaner" made by the company Voith Sulzer, a roll having a scraper inserted into the corresponding dewatering wire, and/or the like.

In the exemplary embodiment depicted in FIG. 5, conditioning device 50 is positioned between guiding rolls 62 and 68. However, conditioning device 50 may also be positioned in the area of other guide rolls and, for instance, in the area adjacent guide roll 62.

Figure 6:
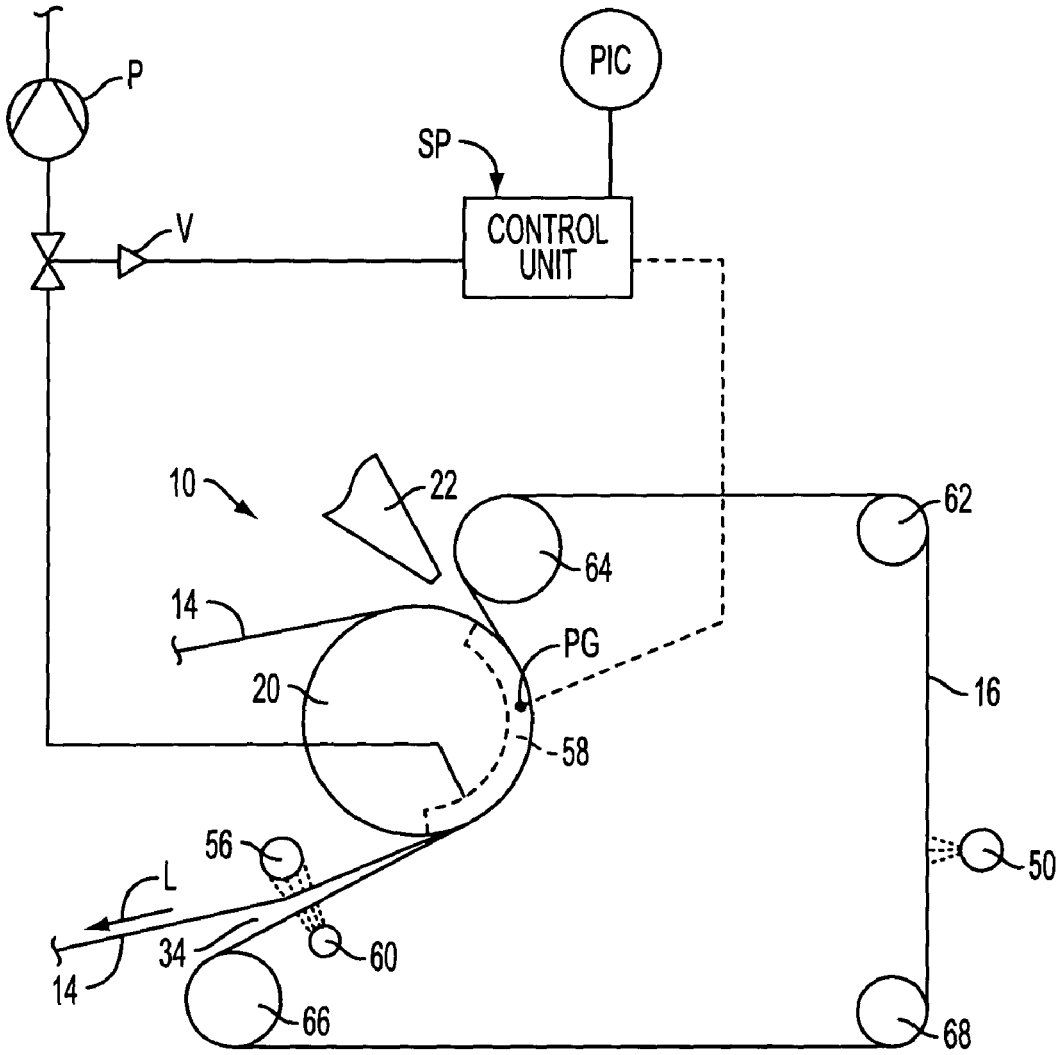
FIG. 6 shows an enlarged view of the forming zone depicted in FIG. 2, which includes an exemplary embodiment for regulating or controlling the vacuum to the suction zone.

FIG. 6 shows an enlarged view of the forming zone of the former depicted in FIG. 2 and illustrates an exemplary embodiment for regulating or controlling the vacuum to the suction zone.

The former utilizes regulated, controlled and/or adjustable vacuum to suction zone 58 which is positioned inside the loop of inner belt 14, in the area of forming roll 20. A vacuum device P which may be a vacuum pump or an exhaust fan or similar vacuum source is connected to suction zone 58 to supply vacuum thereto. A valve V which may be a throttling device or a butterfly valve or the like is position in between the vacuum device P and the suction zone 58 in order to regulate the amount of vacuum which reaches the suction zone 58. A pressure gauge PG is positioned in the area of the suction zone 58 in order to measure a pressure in the suction zone 58. Each of the valve V and the pressure gauge PG is connected to a control unit. The control unit may utilize a set point SP and control instrumentation which functions as a pressure indicated and controlled PIC system. In operation, valve V is set to achieve a certain vacuum in the suction zone 58. The desired vacuum may be achieved, e.g., when the dryness of the tissue web is higher than approximately 8% and preferably higher than approximately 12%. Additionally, it is preferred that the dryness be determined and/or measured after the suction zone 58 in the web travel direction L. The dryness may be measured by various dryness measuring devices such as a radioactive gauge or the like. The dashed line indicates an optional control circuit for the vacuum in the suction zone 58.

Figure 7:
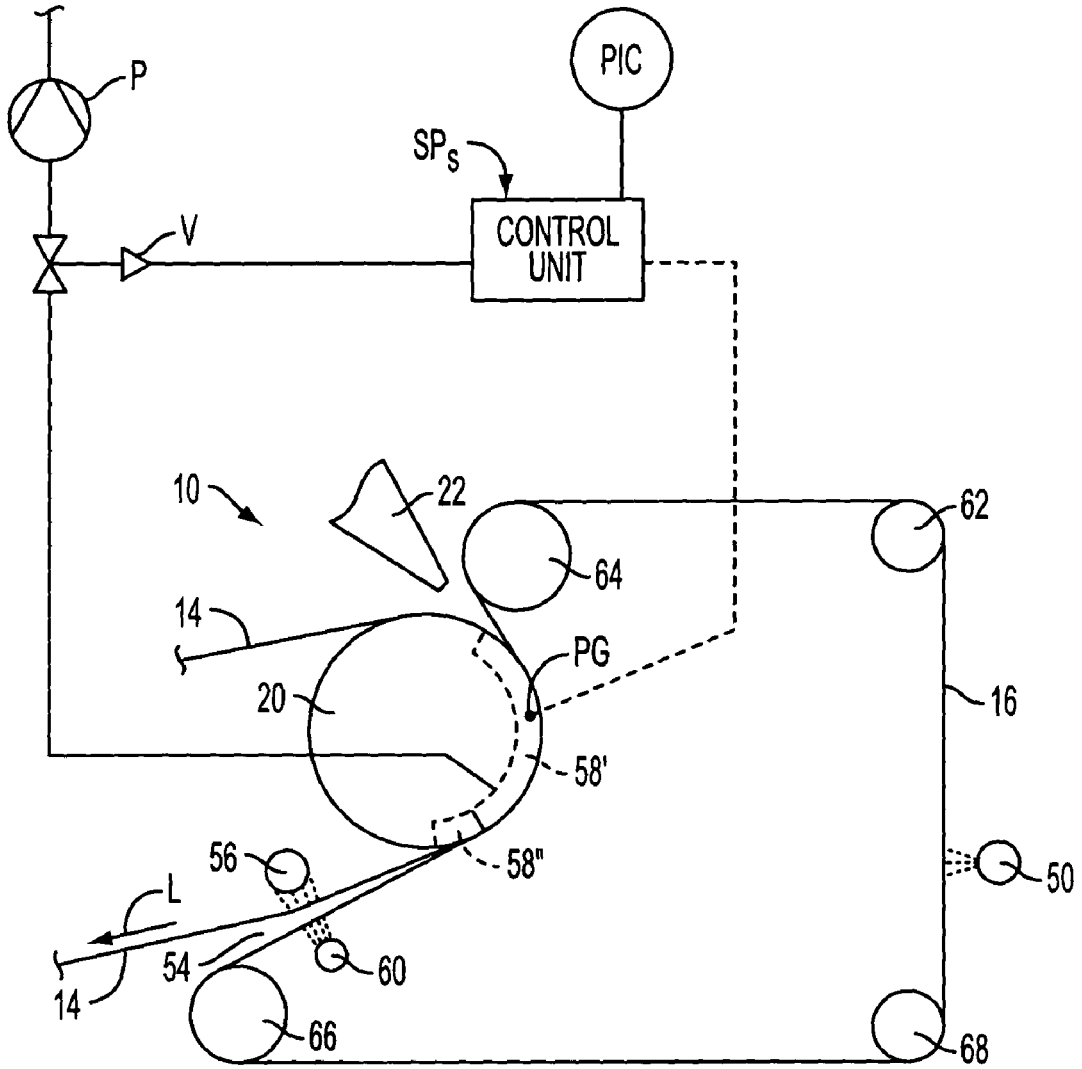
FIG. 7 shows an enlarged view of the forming zone depicted in FIG. 2, which includes a two zone suction zone and an exemplary embodiment for regulating or controlling the vacuum to a two zone suction zone.

FIG. 7 shows an enlarged view of the forming zone of the former depicted in FIG. 2, which includes a two zone suction zone, and illustrates another exemplary embodiment for regulating or controlling the vacuum to a two zone suction zone.

The former utilizes regulated, controlled and/or adjustable vacuum to a two zone suction zone 58' and 58" which is positioned inside the loop of inner belt 14, in the area of forming roll 20. Suction zone is divided into a first suction zone 58' and a second suction zone 58". A vacuum device P which may be a vacuum pump or an exhaust fan or similar vacuum source is connected to suction zone 58 to supply vacuum thereto. A valve V which may be a throttling device or a butterfly valve or the like is position in between the vacuum device P and the suction zone 58 in order to regulate the amount of vacuum which reaches the suction zone 58. A pressure gauge PG is positioned in the area of the suction zone 58 in order to measure a pressure in the suction zone 58. Each of the valve V and the pressure gauge PG is connected to a control unit. The control unit may utilize a set point $SP_s$ and control instrumentation which functions as a pressure indicated and controlled PIC system. In operation, the vacuum in first suction zone 58' may be related and/or determined based upon the dewatering behavior of the web. In second suction zone 58", the vacuum may be related and/or determined based upon the separation behavior of the web from wire 16. In this regard, the stronger the web attaches to the wire 16 at separation 54, the higher the vacuum in zone 58" is adjusted to be in order to improve the ability of the web to detach from wire 16. As in the embodiment of FIG. 6, valve V maybe set to achieve a certain vacuum in each zone 58' and 58". The desired vacuum may be achieved, e.g., when the dryness of the tissue web is higher than approximately 8% and preferably higher than approximately 12%. Additionally, it is preferred that the dryness be determined and/or measured after suction zone 58' or suction zone 58" in the web travel direction L. The dryness may be measured by various dryness measuring devices such as a radioactive gage or the like. The system may also include devices for determining dewatering behavior of the web such as a camera. The dashed line indicates an optional control circuit for the vacuum in either or both suction zones 58' and 58".

Figure 8:
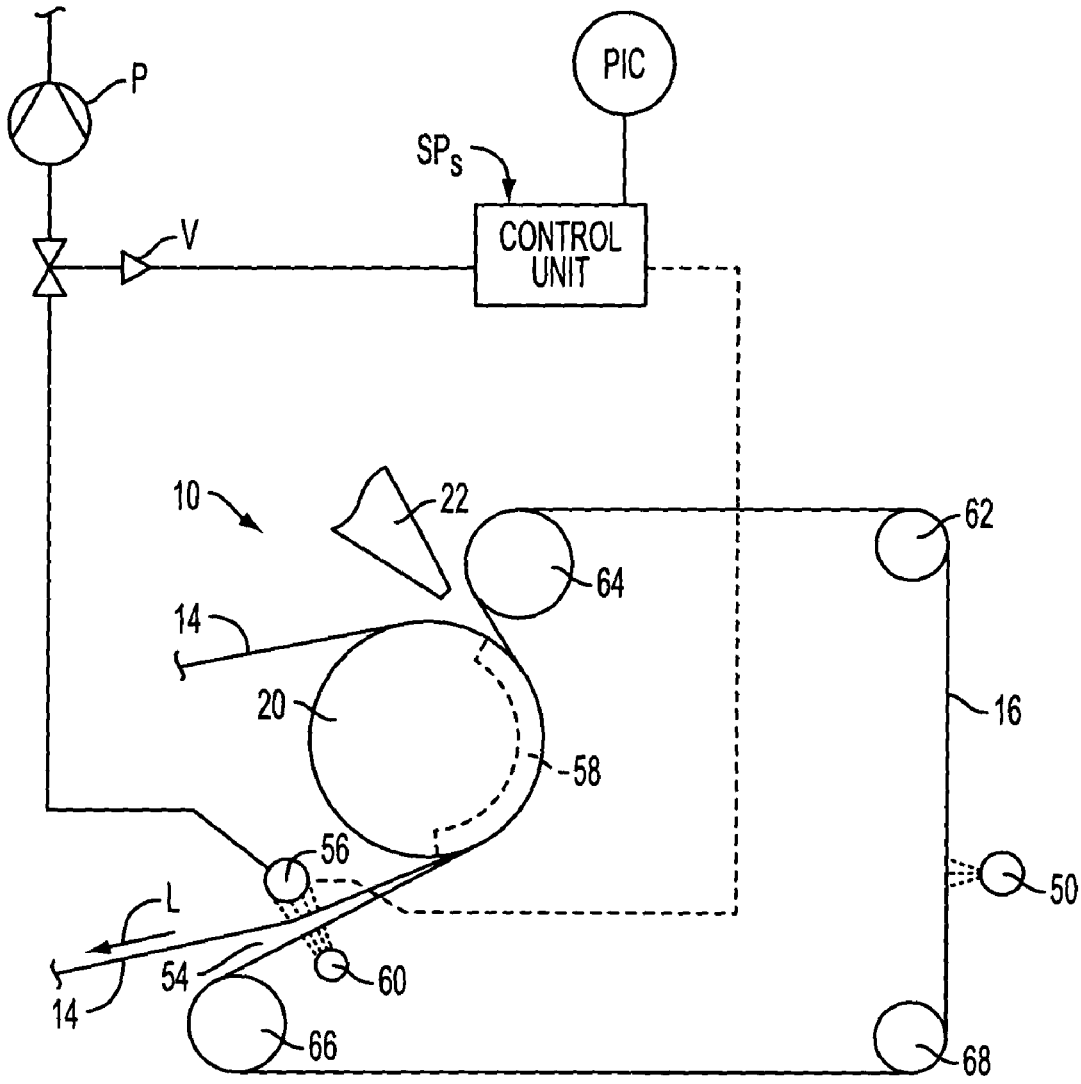
FIG. 8 shows an enlarged view of the forming zone depicted in FIG. 2, which includes another exemplary embodiment for regulating or controlling the vacuum to the suction device.

FIG. 8 shows an enlarged view of the forming zone of the former depicted in FIG. 2 and illustrates another exemplary embodiment for regulating or controlling the vacuum to the suction device.

The former utilizes regulated, controlled and/or adjustable vacuum to suction device 56 which is positioned inside the loop of inner belt 14, in the area of separation point 54. A vacuum device P which may be a vacuum pump or an exhaust fan or similar vacuum source is connected to suction zone 58 to supply vacuum thereto. A valve V which may be a throttling device or a butterfly valve or the like is position in between the vacuum device P and the suction device 56 in order to regulate the amount of vacuum which reaches suction device 56. A pressure gauge PG is positioned in the area of suction device 56 and separation point 54 in order to measure a pressure at suction device 56. Each of the valve V and the pressure gauge PG is connected to a control unit. The control unit may utilize a set point $SP_S$ and control instrumentation which functions as a pressure indicated and controlled PIC system. In operation, valve V is set to achieve a certain vacuum in suction device 56. The desired vacuum may be achieved, e.g., when the dryness of the tissue web is higher than approximately 8% and preferably higher than approximately 12%. Additionally, it is preferred that the dryness be determined and/or measured after the suction zone 58 in the web travel direction L. The dryness may be measured by various dryness measuring devices such as a radioactive gage or the like. Also, vacuum in suction device 56 may relate or be determined by the release behavior of the web from wire 16 as described above in FIG. 7. Moreover, set point $SP_S$ may be set by hand or automatically depending on the release behavior. Accordingly, if the web or a portion of the web, e.g., the edges of the web, is not detached safely from wire 14, the vacuum in suction device 56 may be increased. Such a design allows the web to be separated more safely so that the sheet run is stabilized, e.g., so that the edges of the web do not flutter. Thus, the complete web is in stable contact with wire 14. As in the other embodiments, the dashed line indicates an optional control circuit for the vacuum in the suction device 56.

In should be noted that the vacuum control systems shown in FIGS. 6–8 may be combined into one complete system so that the vacuum in each of suction zone 58 and suction device 56 can be controlled and/or adjusted together. Various dryness measurement devices, separation detection devices, and other devices for determining dewatering behavior may also be included.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCES

10 Former
12 Tissue web
14 Dewatering belt, inner belt
16 Dewatering belt, outer belt
18 Stock entry gap
20 Forming roll
22 Headbox
24 Guide roll
26 Guide roll
28 Guide roll
30 Guide roll
32 Waterproof belt
34 Shoe press
36 Shoe press unit
38 Opposing roll
40 Lower felt
42 Guide roll
44 Guide roll
46 Transfer roll
48 Tissue cylinder, Yankee cylinder
50 Conditioning device
52 Press nip
54 Separation point
56 Suction element
58 Suction zone
60 Blowing element
62 Guiding roll
64 Guiding roll
66 Guiding roll
68 Guiding roll

What is claimed:

1. A machine for producing a tissue web comprising:

a forming area including at least one rotating continuous dewatering wire with a plurality of zones having different wire permeabilities; and at least one shoe press located downstream of said forming area, with respect to a web travel direction, wherein said at least one shoe press has a press nip length, viewed in a belt travel direction, greater than about 80 mm and has a pressure profile over said press nip length with a maximum pressing pressure less than or equal to about 2 MPa.

2. The machine in accordance with claim 1, further comprising a former including a forming element and two rotating continuous dewatering belts;

said two rotating continuous dewatering belts being arranged to converge to form a stock entry gap and being conducted over said forming element as an outer belt, which does not contact said forming element, and as an inner belt, wherein at least one of said outer and said inner belts comprises said at least one rotating continuous dewatering wire with said plurality of zones having different wire permeabilities.

3. The machine in accordance with claim 2, wherein said forming element comprises a forming roll.

4. The machine in accordance with claim 3, wherein said shoe press comprises a separate unit arranged behind, in the belt travel direction, a unit including said forming element and said two dewatering belts.

5. The machine in accordance with claim 3, wherein the tissue web is carried by one of the two dewatering belts subsequent to said forming element, and the tissue web and said one dewatering belt is guided through said shoe press.

6. The machine in accordance with claim 2, wherein said former comprises a twin wire former.

7. The machine in accordance with claim 2, wherein said former comprises a crescent former, and wherein said outer belt comprises said at least one dewatering wire with said plurality of zones having different wire permeabilities and said inner belt comprises a felt belt.

8. The machine in accordance with claim 1, wherein said shoe press comprises a shoe press unit and an opposing element.

9. The machine in accordance with claim 8, wherein said opposing element comprises a drying cylinder.

10. The machine in accordance with claim 8, wherein said opposing element comprises a Yankee cylinder.

11. The machine in accordance with claim 1, wherein said press nip length is less than about 200 mm.

12. The machine in accordance with claim 1, wherein said press nip length is a maximum of about 150 mm.

13. The machine in accordance with claim 1, further comprising a drying zone in which the tissue web is acted upon at least partially by pressurized displacement gas.

14. The machine in accordance with claim 1, wherein said at least one dewatering wire with said plurality of zones having different wire permeabilities is located in an initial dewatering area.

15. The machine in accordance with claim 1, wherein said at least one dewatering wire with said plurality of zones having different wire permeabilities comprises a fabric formed by filling and warp yarns.

16. The machine in accordance with claim 15, wherein said at least one dewatering wire with said plurality of zones having different wire permeabilities comprises a fabric formed only by filling and warp yarns.

17. The machine in accordance with claim 15, wherein zones of different wire permeability of said at least one dewatering wire are produced by at least one of weaving yarns of different diameter and different weave pattern.

18. The machine in accordance with claim 1, further comprising a conditioning device assigned to said at least one dewatering wire with said plurality of zones having different wire permeabilities.

19. The machine in accordance with claim 18, wherein said conditioning device comprises a wire cleaning device.

20. The machine in accordance with claim 1, wherein said zones of different wire permeabilities are formed by warp and weft threads.

21. The machine in accordance with claim 1, wherein said zones of different wire permeabilities are structured to provide at least two different dewatering speeds.

22. A process for producing a tissue web in a tissue machine having a forming area including at least one rotating continuous dewatering wire with a plurality of zones having different wire permeabilities and at least one shoe press, the process comprising:

dewatering the tissue web with at least the at least one continuous dewatering wire with the plurality of zones having different wire permeabilities; and pressing the tissue web in the at least one shoe press, which has a press nip length, viewed in a belt travel direction, greater than about 80 mm and which is located downstream of the forming area, such that a pressure profile over the press nip length has a maximum pressing pressure less than or equal to about 2 MPa.

23. The process in accordance with claim 22, wherein the tissue machine further including a former with a forming element and two rotating continuous dewatering belts arranged to converge to form a stock entry gap and then guided over the forming element as an outer belt, which does not contact the forming element, and as an inner belt, such that at least one of said outer and said inner belts comprises said at least one rotating continuous dewatering wire with the plurality of zones having different wire permeabilities, and said process further comprises:

forming the tissue web between the inner and outer belts; and guiding the inner and outer belts and tissue web over the forming element.

24. The process in accordance with claim 23, wherein the forming element comprises a forming roll, and said process further comprises:

guiding the inner and outer belts and the tissue web over the forming roll.

25. The process in accordance with claim 23, wherein the shoe press is arranged as a separate from, and behind in a belt travel direction, a unit including the forming element and the two dewatering belts.

26. The process in accordance with claim 23, further comprising:

carrying, after the forming element and on one of the two dewatering belts, the tissue web; and guiding the tissue web and the one dewatering belt through the shoe press.

27. The process in accordance with claim 23, wherein said former comprises a twin wire former.

28. The process in accordance with claim 23, wherein said former comprises a crescent former, and the outer belt comprises the at least one dewatering wire with the plurality of zones having different wire permeabilities, and the inner belt comprises a felt belt.

29. The process in accordance with claim 22, further comprising:

dewatering at a machine speed greater than about 1300 m/min.

30. The process in accordance with claim 22, further comprising:

dewatering at a machine speed greater than about 1500 m/min.

31. The process in accordance with claim 22, further comprising:

dewatering at a machine speed greater than about 1800 m/min.

32. The process in accordance with claim 22, further comprising dewatering the tissue web, in an initial dewatering area, with at least the at least one dewatering wire with the plurality of zones having different wire permeabilities.

33. The process in accordance with claim 22, wherein the at least one dewatering wire with the plurality of zones having different wire permeabilities comprises a fabric formed by filling and warp yarns.

34. The process in accordance with claim 33, wherein the at least one dewatering wire with the plurality of zones having different wire permeabilities comprises a fabric formed only by filling and warp yarns.

35. The process in accordance with claim 22, wherein the at least one dewatering wire with the plurality of zones having different wire permeabilities comprises zones of different wire permeability formed by at least one of weaving yarns of different diameter and different weave pattern.

36. The process in accordance with claim 22, wherein the at least one dewatering wire with the plurality of zones having different wire permeabilities is located in an area in which solids content of the tissue web is less than about 20%.

37. The process in accordance with claim 36, wherein the at least one dewatering wire with the plurality of zones having different wire permeabilities is located in an area in which solids content of the tissue web is less than about 12%.

38. The process in accordance with claim 36, wherein the at least one dewatering wire with the plurality of zones having different wire permeabilities is located in an initial sheet forming area having a solids content of less than about 6%.

39. The process in accordance with claim 22, wherein said zones of different wire permeabilities are formed by warp and weft threads.

40. The process in accordance with claim 22, wherein said zones of different wire permeabilities are structured to provide at least two different dewatering speeds.

41. An tissue paper former comprising:

a forming element;

at least two rotating continuous dewatering wires, in which at least one of said two rotating continuous dewatering wires has a plurality of zones with different wire permeabilities, arranged over said forming element, as an outer wire not in contact with said forming element and as an inner wire; and at least one shoe press arranged downstream, relative to a wire travel direction, from said forming element, wherein said at least one shoe press has a press nip length, viewed in a belt travel direction, greater than about 80 mm and has a pressure profile over said press nip length with a maximum pressing pressure less than or equal to about 2 MPa.

42. The tissue paper former in accordance with claim 41, wherein said forming element comprises a forming roll.

43. The tissue paper former in accordance with claim 42, wherein the at least one dewatering wire with said plurality of zones with different wire permeabilities comprises a plurality of zones in which each zone has a maximum extension of less than about 5 mm.

44. The tissue paper former in accordance with claim 43, wherein said maximum extension of each said zone is less than about 3 mm.

45. The tissue paper former in accordance with claim 42, wherein said former comprises a crescent former, and wherein said outer belt comprises said at least one dewatering wire with said plurality of zones with different wire permeabilities and said inner belt comprises a felt belt.

46. The tissue paper former in accordance with claim 45, further comprising a suction zone located within a loop of said inner belt; and a conditioning device associated with said outer belt.

47. The tissue paper former in accordance with claim 46, wherein said suction zone is located in said forming roll.

48. The tissue paper former in accordance with claim 47, further comprising an apparatus to one of control or regulate said suction zone.

49. The tissue paper former in accordance with claim 47, wherein said suction zone comprises at least two suction zones separated in a belt run direction.

50. The tissue paper former in accordance with claim 49, further comprising an apparatus to one of control or regulate said at least two suction zones.

51. The tissue paper former in accordance with claim 41, wherein said zones of different wire permeabilities are formed by warp and weft threads.

52. The tissue paper former in accordance with claim 41, wherein said zones of different wire permeabilities are structured to provide at least two different dewatering speeds.

* * * * *